US006682396B1

(12) United States Patent
Shih et al.

(10) Patent No.: US 6,682,396 B1
(45) Date of Patent: Jan. 27, 2004

(54) APPARATUS AND METHOD FOR LINEAR POLISHING

(75) Inventors: Tsu Shih, Hsin-Chu (TW); Chen-Hua Yu, Hsin-Chu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 09/546,583

(22) Filed: Apr. 11, 2000

(51) Int. Cl.[7] ..... B24B 49/00

(52) U.S. Cl. ..... 451/5; 451/165; 451/168; 451/173

(58) Field of Search ..... 451/5, 165, 168, 451/173, 162, 164

(56) References Cited

U.S. PATENT DOCUMENTS

| | | | | | |
|---|---|---|---|---|---|
| 5,522,965 | A | * | 6/1996 | Chisholm et al. | 156/636.1 |
| 5,643,044 | A | * | 7/1997 | Lund | 451/5 |
| 5,688,364 | A | * | 11/1997 | Sato | 451/165 |
| 5,899,794 | A | * | 5/1999 | Shige et al. | 451/41 |
| 5,961,372 | A | * | 10/1999 | Shendon | 451/41 |
| 6,184,139 | B1 | * | 2/2001 | Adams et al. | 438/691 |
| 6,306,013 | B1 | * | 10/2001 | Horie et al. | 451/41 |

FOREIGN PATENT DOCUMENTS

| | | | | |
|---|---|---|---|---|
| JP | 1-205427 | * | 8/1989 | H01L/21/32 |
| JP | 4-219621 | * | 8/1992 | G11B/5/82 |
| JP | 11-297665 | * | 10/1999 | H01L/21/306 |

OTHER PUBLICATIONS

English translation of JP 1–205427, previously cited.*

* cited by examiner

*Primary Examiner*—Maurina Rachuba
(74) *Attorney, Agent, or Firm*—Tung & Associates

(57) ABSTRACT

A linear polisher for polishing a substrate that always provides a fresh abrasive surface for polishing and a method for linear polishing a substrate are described. In the linear polisher, a length of a polishing pad is supported on a pair of rollers which are driven by a motor means for either intermittently or continuously advancing the pad during a polishing process. A vibration generator which is connected to the polishing pad through an adaptor provides lateral, or vibration in a transverse direction of the pad throughout the polishing process. The present invention novel linear polisher enables substantially constant removal rate to be achieved throughout the pad life of a polishing pad without deterioration such as that normally seen in a conventional rotary or linear CMP apparatus. Optionally, a rotatable substrate holder is utilized to further improve the polishing uniformity of the linear polishing apparatus.

10 Claims, 4 Drawing Sheets

APPARATUS AND METHOD FOR LINEAR POLISHING

FIELD OF THE INVENTION

The present invention generally relates to a polishing pad for a chemical mechanical polishing apparatus and a method for forming the pad and more particularly, relates to a polishing pad for a linear chemical mechanical polishing apparatus for achieving improved polishing uniformity and a method for forming the pad.

BACKGROUND OF THE INVENTION

In the fabrication of semiconductor devices from a silicon wafer, a variety of semiconductor processing equipment and tools are utilized. One of these processing tools is used for polishing thin, flat semiconductor wafers to obtain a planarized surface. A planarized surface is highly desirable on a shadow trench isolation (STI) layer, on an inter-layer dielectric (ILD) or on an inter-metal dielectric (IMD) layer which are frequently used in memory devices. The planarization process is important since it enables the use of a high resolution lithographic process to fabricate the next level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing or CMP. The process has been widely used on ILD or IMD layers in fabricating modern semiconductor devices. A CMP process is performed by using a rotating platen in combination with a pneumatically actuated polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica or aluminum.

A polishing pad used on a rotating platen is typically constructed in two layers overlying a platen with a resilient layer as an outer layer of the pad. The layers are typically made of a polymeric material such as polyurethane and may include a filler for controlling the dimensional stability of the layers. A polishing pad is typically made several times the diameter of a wafer, in a conventional rotary CMP, while the wafer is kept off-center on the pad in order to prevent polishing a non-planar surface onto the wafer. The wafer itself is also rotated during the polishing process to prevent polishing a tapered profile onto the wafer surface. The axis or rotation of the wafer and the axis of rotation of the pad are deliberately not collinear, however, the two axes must be parallel. It is known that uniformity in wafer polishing by a CMP process is a function of pressure, velocity and concentration of the slurry used.

A CMP process is frequently used in the planarization of an ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 5000 Å and about 10,000 Å. The uniformity requirement for ILD or IMD polishing is very stringent since non-uniform dielectric films lead to poor lithography and resulting window etching or plug formation difficulties. The CMP process has also been applied to polishing metals, for instance, in tungsten plug formation and in embedded structures. A metal polishing process involves a polishing chemistry that is significantly different than that required for oxide polishing.

The important component needed in a CMP process is an automated rotating polishing platen and a wafer holder, which both exert a pressure on the wafer and rotate the wafer independently of the rotation of the platen. The polishing or the removal of surface layers is accomplished by a polishing slurry consisting mainly of colloidal silica suspended in deionized water or KOH solution. The slurry is frequently fed by an automatic slurry feeding system in order to ensure the uniform wetting of the polishing pad and the proper delivery and recovery of the slurry. For a high volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in controlling polishing rates and different locations on a wafer surface. Since the polishing rate applied to a wafer surface is generally proportional to the relative velocity of the polishing pad, the polishing rate at a specific point on the wafer surface depends on the distance from the axis of rotation. In other words, the polishing rate obtained at the edge portion of the wafer that is closest to the rotational axis of the polishing pad is less than the polishing rate obtained at the opposite edge of the wafer. Even though this is compensated by rotating the wafer surface during the polishing process such that a uniform average polishing rate can be obtained, the wafer surface, in general, is exposed to a variable polishing rate during the CMP process.

More recently, a new chemical mechanical polishing method has been developed in which the polishing pad is not moved in a rotational manner but instead, in a linear manner. It is therefor named as a linear chemical mechanical polishing process in which a polishing pad is moved in a linear manner in relation to a rotating wafer surface. The linear polishing method affords a uniform polishing rate across a wafer surface throughout a planerization process for uniformly removing a film player of the surface of a wafer. One added advantage of the linear CMP system is the simpler construction of the apparatus and therefore not only reducing the cost of the apparatus but also reduces the floor space required in a clean room environment.

A typical linear CMP apparatus 10 is shown in FIGS. 1A and 1B. The linear CMP apparatus 10 is utilized for polishing a semi-conductor wafer 24, i.e. a silicon wafer for removing a film layer of either an insulating material or a wafer from the wafer surface. For instance, the film layer to be removed may include insulating materials such as silicon oxide, silicon nitrite or spin-on-glass material or a metal layer such as aluminum, copper or tungsten. Various other materials such as metal alloys or semi-conducting materials such as polysilicon may also be removed.

As shown in FIGS. 1A and 1B, the wafer 24 is mounted on a rotating platform, or wafer holder 18 which rotates at a pre-determined speed. The major difference between the linear polisher 10 and a conventional CMP is that a continuous, or endless belt 12 is utilized instead of a rotating polishing pad. The belt 12 moves in a linear manner in respect to the rotational surface of the wafer 24. The linear belt 12 is mounted in a continuous manner over a pair of rollers 14 which are, in turn, driven by a motor means (not shown) at a pre-determined rotational speed. The rotational motion of the rollers 14 is transformed into a linear motion 26 in respect to the surface of the wafer 24. This is shown in FIG. 1B.

In the linear polisher 10, a polishing pad 30 is adhesively joined to the continuous belt 12 on its outer surface that faces the wafer 24. A polishing assembly 40 is thus formed by the continuous belt 12 and the polishing pad 30 glued thereto. As shown in FIG. 1A, a plurality of polishing pad 30 are utilized which are frequently supplied in rectangular-shaped pieces with a pressure sensitive layer coated on the back side.

The wafer platform 18 and the wafer 24 forms an assembly of a wafer carrier 28. The wafer 24 is normally held in position by a mechanical retainer, commonly known as a retaining ring 16, as shown in FIG. 1B. The major function of the retaining ring 16 is to fix the wafer in position in the wafer carrier 28 during the linear polishing process and thus preventing the wafer from moving horizontally as wafer 24 contacts the polishing pad 30. The wafer carrier 28 is normally operated in a rotational mode such that a more uniform polishing on wafer 24 can be achieved. To further improve the uniformity of linear polishing, a support housing 32 is utilized to provide support to support platen 22 during a polishing process. The support platen 22 provides a supporting platform for the underside of the continuous belt 12 to ensure that the polishing pad 30 makes sufficient contact with the surface of wafer 24 in order to achieve more uniform removal in the surface layer. Typically, the wafer carrier 28 is pressed downwardly against the continuous belt 12 and the polishing pad 30 at a predetermined force such that a suitable polishing rate on the surface of wafer 24 can be obtained. A desirable polishing rate on the wafer surface can therefore by obtained by suitably adjusting forces on the support housing 32, the wafer carrier 28, and the linear speed 26 of the polishing pad 30. A slurry dispenser 20 is further utilized to dispense a slurry solution 34.

In the conventional rotary CMA and linear CMA process, while each presenting certain processing advantages, both techniques suffer from a problem of not being able to maintain polishing uniformity. The lack of polishing uniformity by the rotary CMA technique and the linear CMA technique is caused by a steady decrease in the removal rates of the substrate material after prolonged use of the polishing pad. This is shown in FIGS. 2A–2C and 3A–3B.

FIG. 2A shows a typical rotary CMA polishing pad 50 which is mounted on a polishing platen 52, shown in FIG. 2B. The polishing platen 52 rotates with the polishing pad 50 on top during a rotary polishing process. The removal rate varies with the pad life and decreases significantly as the polishing pad 50 has been used extensively, i.e. for about 200 or 300 wafers.

Similar deterioration in the removal rates with pad life is seen in linear CMP process, as shown in FIGS. 3A~3C. For instance, FIG. 3A illustrates a linear polishing pad 30 similar to that shown in FIG. 1A. The polishing pad is supported by a pair of rollers 14, also shown in FIG. 1A, for continuous rotation by a motor (not shown). It should be noted that FIG. 3B illustrates a simplified drawing of a linear CMP apparatus and as such, only the polishing pad 30 and the rollers 14 are shown. The dependency of the removal rates on the pad life for the linear CMP method is shown in FIG. 3C illustrating a significant drop in the removal rates after the linear polishing pad had been used extensively, i.e. for polishing between 200 and 300 wafers. The significant drop in the removal rates leads to a polishing uniformity problem and furthermore, leads to the premature replacement of the polishing pad. The more frequent replacement of the polishing pad that is necessary in either the rotary CMP apparatus or the linear CMP apparatus results in decreased yield of the polishing process.

It is therefore an object of the present invention to provide an apparatus and a method for linear polishing that does not have the drawbacks or shortcomings of the continuous belt type linear polishing apparatus.

It is another object of the present invention to provide an apparatus for linear polishing that does not utilize an endless loop of a polishing pad.

It is a further object of the present invention to provide an apparatus for linear polishing that is equipped with a vibration generator for causing the polishing pad to vibrate in a transverse direction of the pad.

It is another further object of the present invention to provide a linear polisher for polishing a substrate consists of a length of a polishing pad supported on a pair of roller means.

It is still another object of the present invention to provide a linear polisher for polishing a substrate consists of a length of a polishing pad, a pair of roller means, a motor means, a vibration generator and a substrate holder.

It is yet another object of the present invention to provide a linear polisher for polishing a substrate that is equipped with a vibration generator for vibrating the pad in a transverse direction in a frequency range between 10/sec and 1,000/sec.

It is still another further object of the present invention to provide a method for linear polishing a substrate that includes the step of vibrating a length of a polishing pad in the transverse direction at a frequency of at least 10/sec.

It is yet another further object of the present invention to provide a method for linear polishing a substrate by vibrating the polishing pad in a transverse direction and rotating a substrate in contact with the polishing pad at a rotational speed of at least 50 RPM.

SUMMARY OF THE INVENTION

In accordance with the present invention, an apparatus and a method for linear polishing that does not use an endless loop of a polishing pad are provided.

In a preferred embodiment, a linear polisher for polishing a substrate is provided which includes a length of a polishing pad that has a first end and a second end, a first roller means for removably attaching the first end of the polishing pad thereto and a second roller means for removably attaching the second end of the polishing pad thereto, a motor means for rotating the first roller means such that the polishing pad moves from the second roller means to the first roller means in a longitudinal direction, a vibration generator for causing the polishing pad to vibrate in a transverse direction of the pad, and a substrate holder for mounting the substrate thereto and for pressing an exposed surface of the substrate onto a top surface of the polishing pad.

In the linear polisher for polishing a substrate, the polishing pad may be fabricated of a polymeric material. The first roller means may be a take-up roller for taking up consumed polishing pad and the second roller means may be a storage roller for storing unused polishing pad. The motor means may rotate the first roller means intermittently or continuously. The motor means may rotate the first roller means intermittently after each polishing process for a substrate. The vibration generator may generate vibrations in an ultrasonic frequency range.

In the linear polisher for polishing a substrate, the vibration generator generates vibrations in a frequency range between about 10 cycle/sec and about 1,000 cycle/sec. The vibration generator generates vibrations that have an amplitude between about 0.01 inch and about 1 inch. The polishing pad advances intermittently for a distance of at least ¼ inch after each polishing process for a substrate is completed. The vibration generator may be coupled to the polishing pad through an adaptor for causing the pad to vibrate in a transverse direction. The substrate holder may be equipped with a pressure means for pressing the substrate onto the polishing pad. The substrate holder may be equipped with a rotation means for rotating the substrate at a rotational speed of at least 50 RPM.

The present invention further discloses a method for linear polishing a substrate which can be carried out by the operating steps of providing a length of a polishing pad that has an abrasive top surface and a length larger than a width. By vibrating the polishing pad in the width (or transverse) direction at a frequency of at least 10 cycle/sec, and pressing a surface of the substrate to be polished on the abrasive top surface of the polishing pad.

The method for linear polishing a substrate may further include the step of rotating the substrate to a rotational speed of at least 50 RPM during the pressing step. The method may further include the step of advancing the length of polishing pad during the linear polishing process. The method may further include the step of advancing the length of polishing pad after a polishing process for a substrate by at least ¼ inch. The method may further include the step of positioning the length of polishing pad on a pair of roller means. The method may further include the step of rotating at least one of the pair of roller means by a motor means. The method may further include the step of vibrating the polishing pad in the width direction at a frequency between about 10 cycle/sec and about 1,000 cycle/sec. The method may further include the step of vibrating the polishing pad to an amplitude of between about 0.01 inch and about 1 inch.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

In accordance with the present invention, a linear polisher for polishing a substrate and a method for polishing a substrate by using the linear polisher are disclosed.

The present invention linear polisher can be constructed by a length of a polishing pad which has a first end and a second end, a first roller for removably attaching the first end of the polishing pad thereto and a second roller for removably attaching the second end of the polishing pad thereto, a motor means for rotating at least one of the first and second roller, a vibration generator for vibrating the polishing pad in a transverse direction, and a substrate holder for mounting the substrate and for pressing the substrate onto the polishing pad. The present invention polishing pad may be fabricated of a polymeric material, such as polyurethane, or any other rigid plastic material. The length of polishing pad can be advanced, i.e. by a motorized first roller, either intermittently after each polishing process for a substrate is completed or continuously such that a fresh, unused polishing pad surface is always available for polishing a newly installed substrate. The present invention apparatus enables a constant removal rate to be maintained throughout the pad life of the polishing pad. This is not previously achievable by either the rotary or the linear CMP technique. The major advantage achieved by the present invention novel polishing apparatus is therefore the achievement of a consistent removal rate which does not deteriorate with pad life. The consistent removal rate enables a significantly improved uniformity of polishing to be achieved on the substrate surface.

Figure 1A:
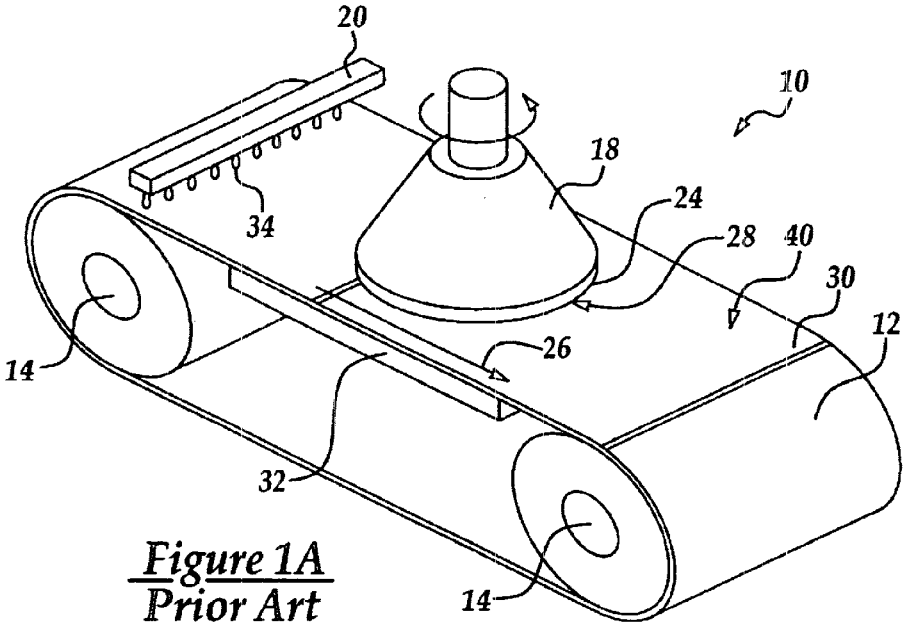
Figure 1A Prior Art
FIG. 1A is a perspective view of a conventional, linear chemical mechanical polishing apparatus utilizing a continuous belt.
Figure 1B:
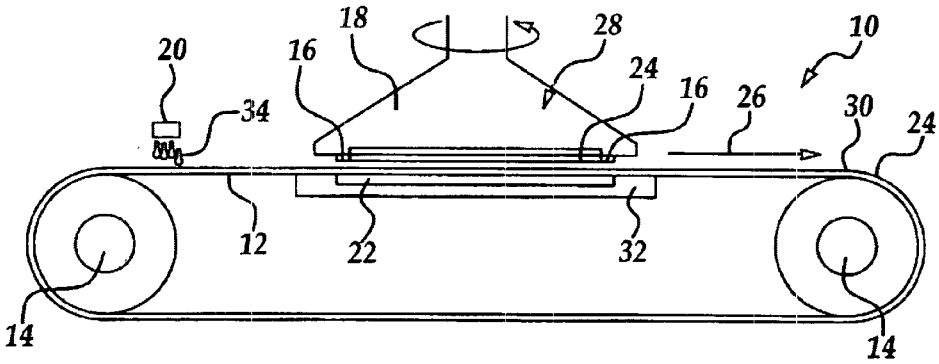
Figure 1B Prior Art
FIG. 1B is a side view of the conventional chemical mechanical polishing apparatus of FIG. 1A.
Figure 2A:
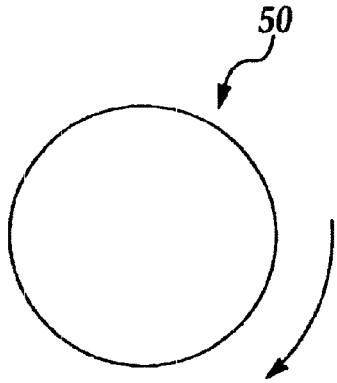
Figure 2A Prior Art
FIG. 2A is a plane view of a conventional rotary chemical mechanical polishing pad.
Figure 2B:
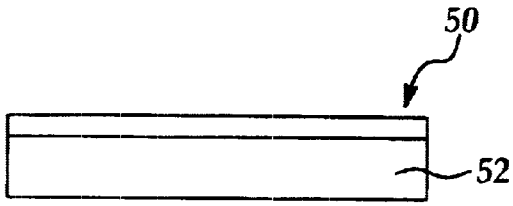
Figure 2B Prior Art
FIG. 2B is a cross-sectional view of the conventional rotary chemical mechanical polishing pad of FIG. 2A.
Figure 2C:
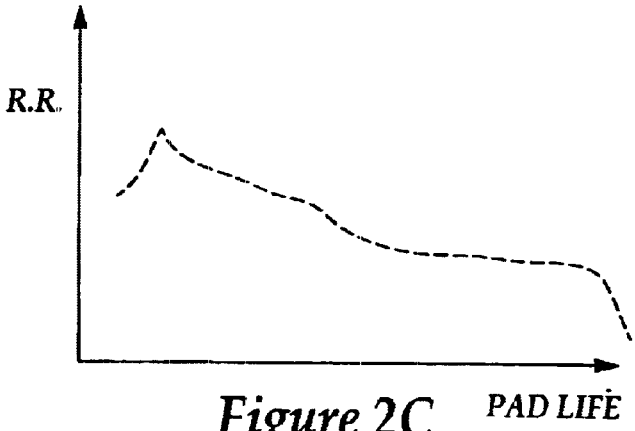
Figure 2C Prior Art
FIG. 2C is a graph illustrating the dependency of removal rates on the pad life for a rotary chemical mechanical polishing pad.
Figure 3A:
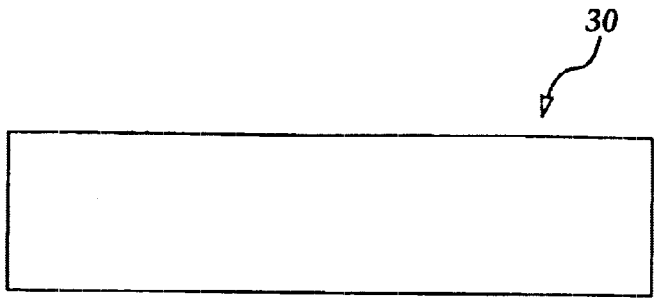
Figure 3A Prior Art
FIG. 3A is a plane view of a conventional linear chemical mechanical polishing pad.
Figure 3B:
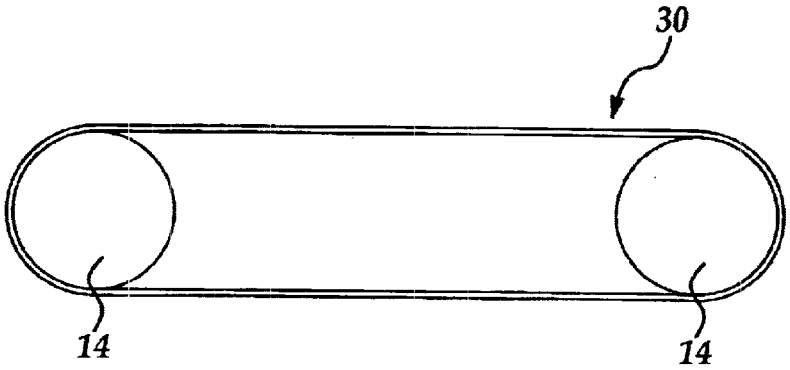
Figure 3B Prior Art
FIG. 3B is a side view of the conventional linear chemical mechanical polishing pad of FIG. 3A supported on a pair of rollers.
Figure 3C:
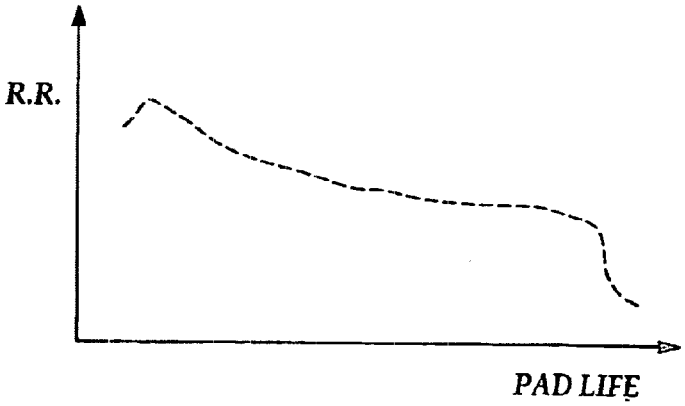
Figure 3C Prior Art
FIG. 3C is a graph illustrating the dependency of removal rates on the pad life for the linear chemical mechanical polishing pad.
Figure 4A:
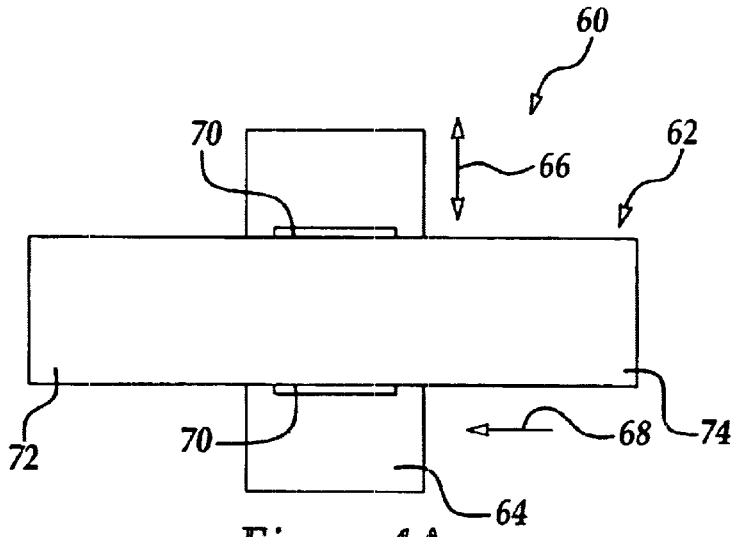
Figure 4A Prior Art
FIG. 4A is a plane view of the present invention linear polishing pad equipped with a vibration generator.

Referring now to FIG. 4A wherein a plane view of the present invention novel linear polishing apparatus 60 is shown. The linear polishing apparatus is constructed by a length of a linear polishing pad 62 connected to a vibration generator 64 through an adapter 70 such as a metal bracket. The vibration generator 64 vibrates in a transverse direction 66 of the polishing pad 62 while the polishing pad advances intermittently, or continuously in a longitudinal direction 68. The length of polishing pad 62 may be constructed of a polymeric material, such as polyurethane or any other rigid thermoplastic material. The top surface of the polishing pad 62 is formed in a specific pattern for creating the abrasion effect. For instance, the pattern of linear grooves, apertures or protrusions may be formed on the top surface for creating the abrasion effect.

Figure 4B:
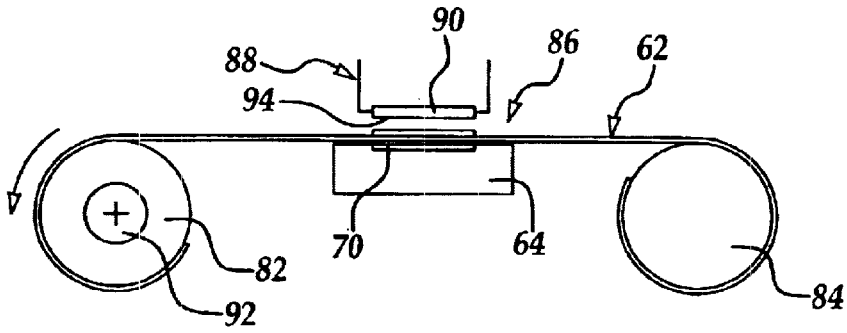
Figure 4B Prior Art
FIG. 4B is a side view of the present invention linear polishing pad equipped with the vibration generator of FIG. 4A supported on a pair of rollers.

The first end 72 of the length of polishing pad 62 may be removably attached to a first roller means 82, as shown in FIG. 4B. The second end 74 of the length of polishing pad 62 may be attached to the second roller means 84. A motor means 92 maybe attached to the first roller 82 for providing rotational motion in a counter-clockwise direction for taking up the used, or consumed polishing pad on the first roller 82. The second roller 84 is used to store the unused polishing pad and to feed the unused polishing pad to the polishing station 86 directly under a substrate holder 88. As shown in FIG. 4B, a substrate 90 which has a top surface 94 to be polished is mounted in the substrate holder 88.

The vibration generator 64 produces a vibration either in an ultrasonic frequency range or in any other suitable frequency range. For instance, a suitable frequency range has been found to be within a range of about 10 cycle/sec and about 1,000 cycle/sec. In this write-up, the word "about" is to man a range of values that is ±10% of the average value given. The vibration generated by the vibration generator 64 is in the transverse (or width) direction 66 as shown in FIG. 4A. The vibration produced by the vibration generator 64 is transmitted to the polishing pad 62 by an adaptor means 70 that is shown in FIGS. 4A and 4B. The adapter means 70 can be a simple bracket arrangement such as a mechanical bracket that is unitarily attached to the vibration generator 64 while holding the length of polishing pad 62 in a recess (not shown) provided in the top surface of the adapter means 70. In other words, a recessed area may be provided in the top surface of the adapter means 70 for the length of polishing pad 62 to ride therein and for transmitting vibration since the recessed area has a width that fits snuggly the length of polishing pad 62 therein, while still allowing the pad 62 to move in a longitudinal direction when taken up by the first roller means 82. The vibration generators 64 may be supplied in any one of the commercially available units.

The motor means 92 drives the first roller means 82 in either an intermittent manner or in a continuous manner. When driven in an intermittent manner, the length of polishing pad 62 advances by a distance of at least ¼ inch after a polishing process for a substrate is completed. The distance of advancement for the polishing pad may be as high as the full width of a substrate, i.e. an 8 inch distance for an 8 inch silicon wafer. An optimal distance for the advancement of the polishing pad 62 may be between the minimum distance of ¼ inch and the maximum distance of the full width of the substrate. Alternatively, the length of polishing pad 62 may be advanced continuously in a slow motion, such as advancing by 0.01 inch/min during a substrate polishing process.

The vibration frequency generated by the vibration generator 64 may suitably in a range between about 10 cycle/sec and about 1,000 cycle/sec, and preferably between about 50 cycle/sec and about 200 cycle/sec. A suitable amplitude for the vibration may be in the range between about 0.01 inch and about 1 inch, and preferably between about 0.05 inch and about 0.2 inch. The substrate holder 88 may rotate at a suitable rotational speed such as a speed between about 50 RPM and about 1,000 RPM.

It should be noted that the present invention novel linear polishing apparatus can be operated either with or without a polishing slurry dispensed on top of the polishing pad 62. When a polishing slurry is used, either an abrasive type slurry that contains abrasive particles or a slurry that only contains deionized water may be utilized. A commercially available dispensing nozzle may be utilized for dispensing the slurry on top of the length of polishing pad 62 before the pad is moved into the polishing station 86, as shown in FIG. 4B. It is believed that with slurry suspension, the polishing process by the present invention novel linear polisher may be carried out more efficiently and a greater removal rate may be achieved.

Figure 4C:
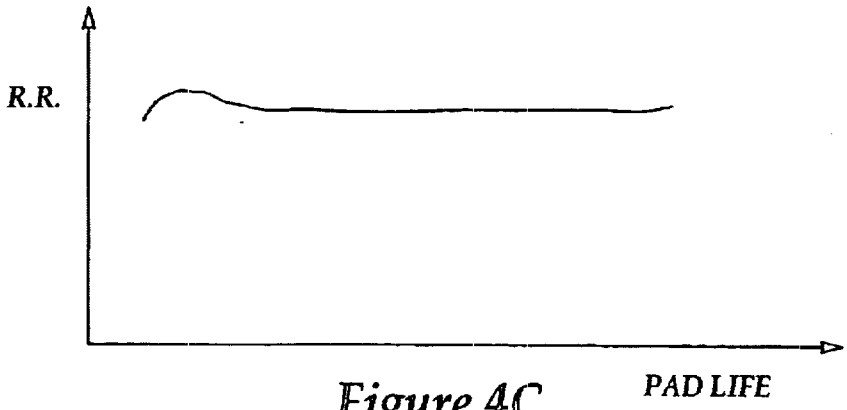
Figure 4C Prior Art
FIG. 4C is a graph illustrating the dependency of removal rates on the pad life for the present invention linear polishing pad.

A major advantage achieved by the present invention novel linear polishing apparatus 60 is shown in FIG. 4C. The removal rates achieved by the present invention novel apparatus remains essentially stable at a high value throughout the pad life of the polishing pad. This is achieved since a new pad surface, or an unused pad surface, is always provided for substrate polishing such that a fresh abrasive surface is always available for achieving the desirable removal rate.

The present invention novel apparatus and a method for utilizing such apparatus have therefore been amply described in the above description and in the appended drawings of 4A–4C.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A linear polisher for polishing a substrate comprising:

a length of a polishing pad having a first end and a second end;

a first roller for removably attaching said first end of the polishing pad thereto and a second roller for removably attaching said second end of the polishing pad thereto;

a motor for rotating said first roller such that said polishing pad moves from said second roller to said first roller in a longitudinal direction, said polishing pad advances intermittently for a distance of at least ¼ inch after each polishing process for a substrate;

a vibration generator for causing said polishing pad to vibrate in a transverse direction of the polishing pad; and a substrate holder for mounting said substrate thereto for pressing an entire exposed surface of said substrate onto a top surface of said polishing pad and for polishing said entire exposure surface of the substrate simultaneously.

2. A linear polisher for polishing a substrate according to claim 1, wherein said polishing pad being fabricated of a polymeric material.

3. A linear polisher for polishing a substrate according to claim 1, wherein said first roller being a take-up roller for taking up used polishing pad and said second roller being a storage roller for storing unused polishing pad.

4. A linear polisher for polishing a substrate according to claim 1, wherein said motor rotates said first roller intermittently.

5. A linear polisher for polishing a substrate according to claim 1, wherein said motor rotates said first roller intermittently after each polishing process for a substrate.

6. A linear polisher for polishing a substrate according to claim 1, wherein said vibration generator generates vibrations in a frequency range between about 10 cycle/sec and about 1000 cycle/sec.

7. A linear polisher for polishing a substrate according to claim 1, wherein said vibration generator generates vibrations having an amplitude between about 0.01 inch and about 1 inch.

8. A linear polisher for polishing a substrate according to claim 1, wherein said vibration generator being coupled to said polishing pad through an adapter for causing said pad to vibrate in a transverse direction.

9. A linear polisher for polishing a substrate according to claim 1, wherein said substrate holder being equipped with a pressure device for pressing said substrate onto said polishing pad.

10. A linear polisher for polishing a substrate according to claim 1, wherein said substrate holder being equipped with a rotating device for rotating said substrate at a rotational speed of at least 50 RPM.

* * * * *